United States Patent [19]

Van Druff, Jr.

[11] Patent Number: 5,007,249

[45] Date of Patent: Apr. 16, 1991

[54] IN STORE KEEP-A-COOLER

[75] Inventor: Albert Van Druff, Jr., Lawrenceville, Ga.

[73] Assignee: Cornerstone Products Inc., Norcross, Ga.

[21] Appl. No.: 487,147

[22] Filed: Mar. 2, 1990

[51] Int. Cl.[5] ..... A47F 3/04

[52] U.S. Cl. ..... 62/255; 62/418; 98/DIG. 7

[58] Field of Search ..... 62/252, 255, 417, 418, 62/407; 98/DIG. 7

[56] References Cited

U.S. PATENT DOCUMENTS

| | | | |
|---|---|---|---|
| 1,907,680 | 5/1933 | Strass | 62/255 |
| 3,552,138 | 1/1971 | Davis | 62/252 X |
| 4,085,986 | 4/1978 | Taub | 62/255 X |
| 4,150,550 | 4/1979 | Mercer, Sr. | 62/252 |
| 4,916,917 | 4/1990 | Jackson, Jr. | 62/252 X |

*Primary Examiner*—William E. Tapoical
*Attorney, Agent, or Firm*—N. J. Aquilino

[57] ABSTRACT

An auxiliary, portable storage and cooling unit in combination with a primary source of refrigerated air providing a secondary source of refrigerated air formed of a housing having an upper product storage compartment and a fan driven refrigerated air flow path including an air inlet duct for connection to the primary source of refrigerated air, an air inlet chamber, air distribution ducts, and air distribution chambers for feeding refrigerated air into the storage compartment.

10 Claims, 4 Drawing Sheets

IN STORE KEEP-A-COOLER

BACKGROUND OF THE INVENTION

The present invention relates to a point of sale food storage and cooling unit and more particularly to an auxiliary storage and cooling unit for use with a conventional food cooler.

In grocery stores and supermarkets, there are a large number of products which are offered for sale to the consumer which require refrigeration and/or cooling in order to keep the product fresh to minimize spoilage. Most large retail grocery stores use large, open top refrigerated cases for storing these types of perishable foods. Whereas such cases work adequately for the purpose of storage and cooling, they are not well designed to accommodate promotions and sales of particular items where it is desirable separate the promotional item from the other items offered for sale for the purpose of emphasis and obtaining the attention of the consumer.

Smaller refrigerator cases which may have the capability of being placed in a separate location, have the disadvantage of being bulky and also requiring a connection to a suitable source of power to maintain the refrigeration system operational.

The present invention is a lightweight, portable food storage and cooler unit capable of being separated from a large refrigerated case for the purpose of providing point of sale promotion of particular food items. The unit uses cool air drawn from conventional refrigerated cases by way of a unique cold air distribution system which maintains the storage compartment of the unit at a consistant cool temperature. The unit is formed as a generally rectangular housing having an upper food storage compartment for storing food items as, for example, jars of salad dressing, or other similar food items which require cool temperatures. A cold air distribution system uses a conventional ventilating hose having an inlet which is placed within a refrigerated case in the retail store. The other end of the hose is connected to the lower end of the cooling unit in fluid communication with a upwardly tapered air distribution funnel. A low power fan creates an upward draft to facilitate the movement of the cool air up and into the cooling compartment. The cool air is distributed within hollow walls of the unit located around the peripheral edges of the food storage compartment, and thereafter through a unique air baffle and distribution system to maintain the entire food compartment at a constant cool temperature.

The entire cooling unit may be made of lightweight material such as corrugated cardboard or other heat insulation laminated material having similar qualities. The unit is portable, and also has the capability of mounting and displaying suitable advertising material unlike conventional refrigerated cases.

Among the objects of the present invention are the provision of a food storage and cooling unit which is portable in nature, and which facilitates a point of sale promotion apart from a conventional refrigerated case.

Another object of the present invention is the provision of a food storage and cooling unit having a unique cool air fluid distribution network insuring equal and consistant cooling temperatures throughout the food storage compartment.

Another object is the provision of a food storage and cooling unit structured to receive point of sale advertising. Still a further object is to provide a food storage and cooling unit which needs no separate source of refrigeration. These and other objects will become apparent with reference to the accompanying drawings and specification.

DESCRIPTION OF THE PREFERRED EMBODIMENTS

Figure 1:
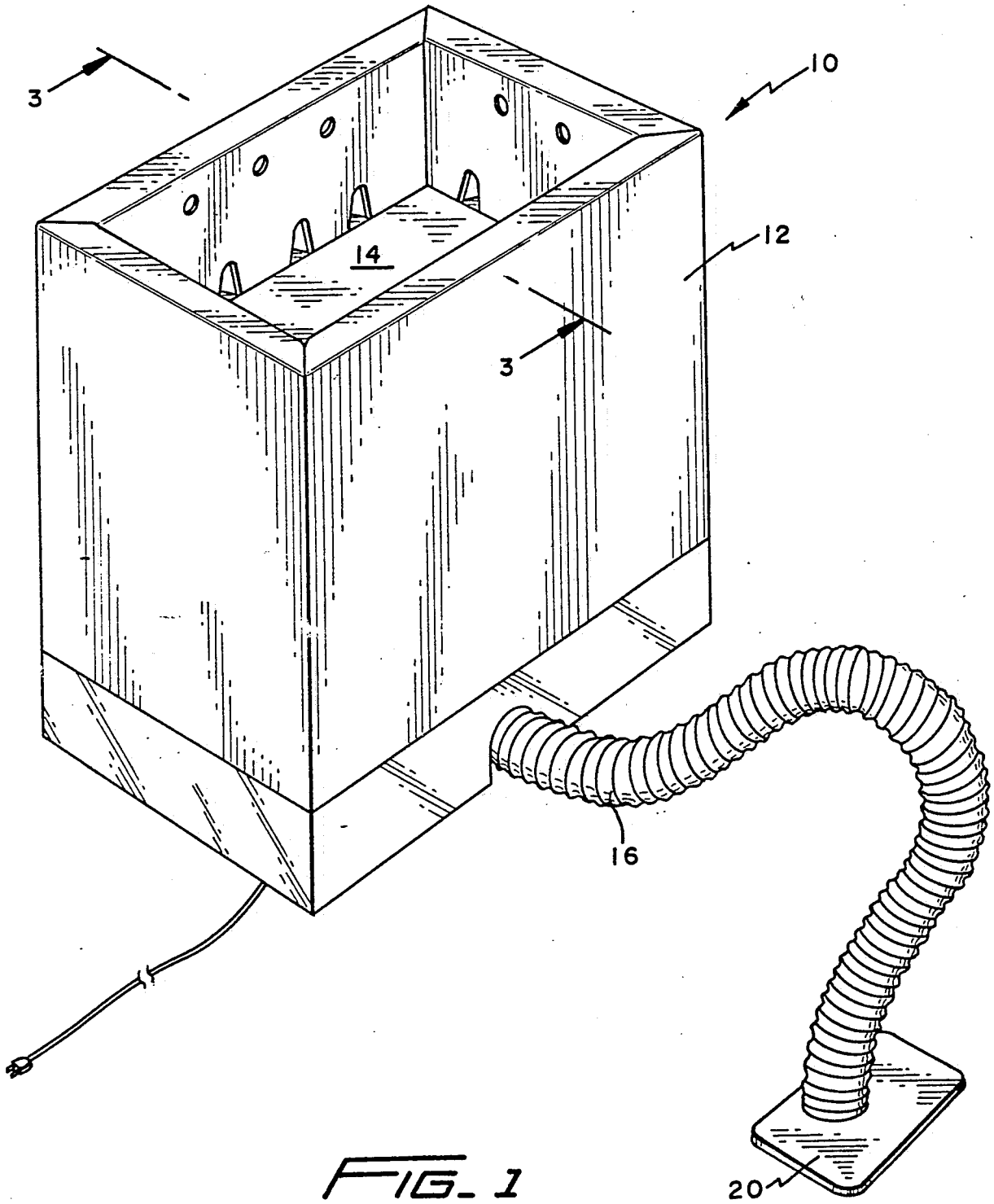
FIG. 1 is a perspective view of the food storage and cooling unit of the present invention.
Figure 2:
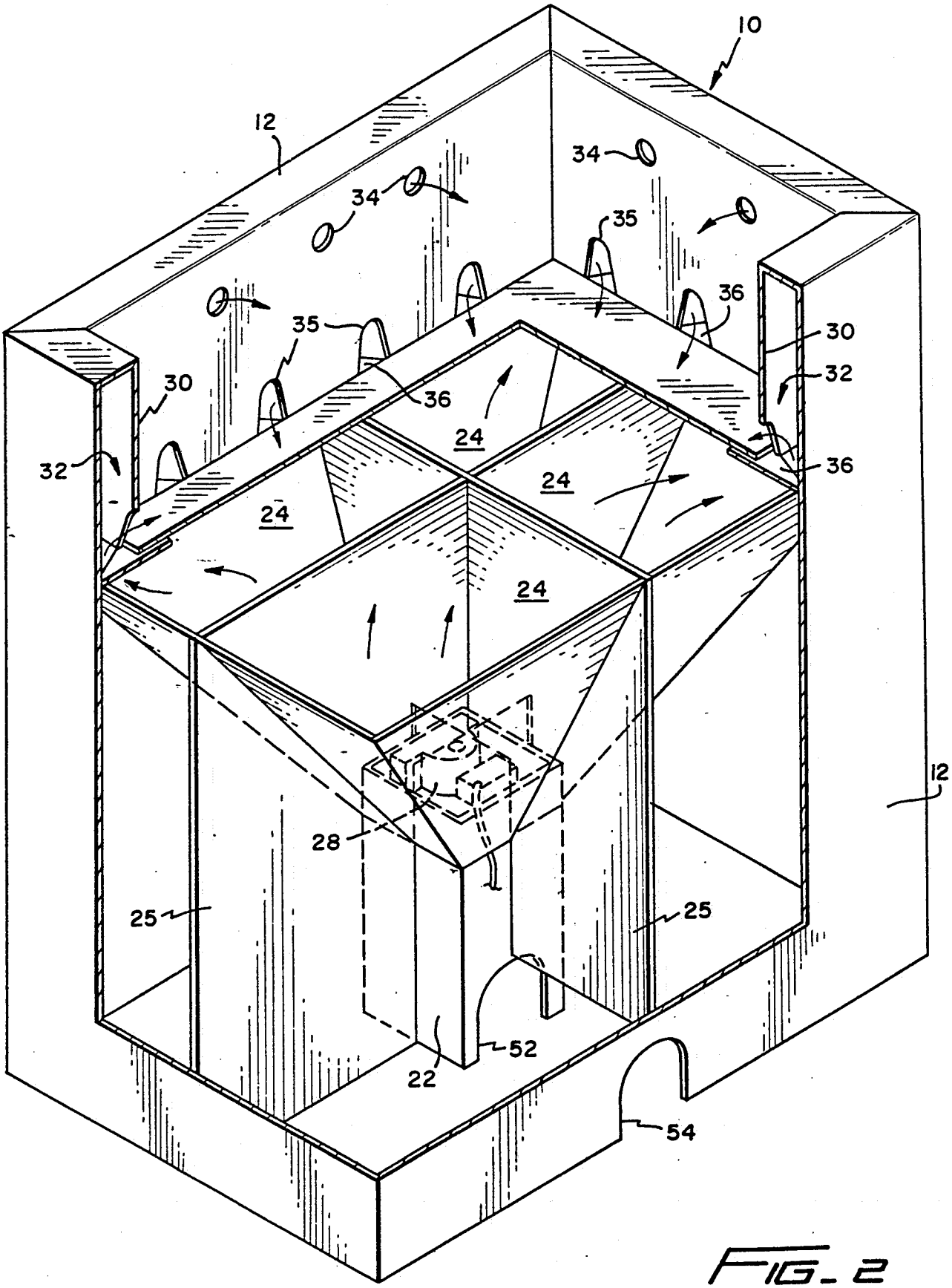
FIG. 2 is a perspective view, partly in section, of the unit shown in FIG. 1.

Referring to the drawings, the food storage and cooling unit 10 is formed of an outer housing 12, which is rectangular in shape and size, to form a food compartment 14 preferrably at a height which would be convenient for a consumer to observe, and subsequently remove, a stored product. As shown in FIG. 1, a cold air inlet hose 16 has an inlet opening 18 mounted on a support 20 which is placed within a conventional refrigerated case (c) located in a retail food outlet. The opposite end of the hose 16 is connected to an inlet chamber 22 located at the lower end of the housing 12. The inlet chamber 22 is in fluid communication with a plurality of funnel-shaped air distribution ducts 24 which extend upwardly from the bottom of the housing 12 to a point below the food compartment 14. The ducts 24 are formed by a plurality of funnel-shaped dividers 26 which extend upwardly from the inlet chamber 22 to the bottom of the food compartment 14. An electrically driven fan 28 is mounted within the chamber 22 to draw inlet air from the chamber 22 through the ducts 24 upwardly toward the food compartment 14. An inner wall 30 in the food compartment cooperates with the outer housing 12 to form an air distribution channel 32 around the outer periphery of the compartment. The upper edge of this channel 32 is closed and a plurality of upper air openings 34 and lower openings 35, as shown in FIG. 2, open into the food compartment 14 thereby permitting air flow into this area.

Since there is no direct connection between the food storage and cooling unit 10 and the refrigerated cases normally found in the retail store outlet, the unit may be moved anywhere adjacent a refrigerated case within the range or length of the inlet hose 16. Since the unit 10 is made of lightweight materials, this facilitates movement even with products stored in the compartment.

The front of the housing may be used for suitable advertising indicia or displays to promote the contents of the unit. The unit is also structured to accommodate a vertical advertising placard (not shown) which may be connected to the rear wall of the housing 12.

Referring in more detail to the structure of the unit 10, it can be seen that the inner wall 30 which forms the air distribution channel 32 is formed by a folded-over extension of the outer housing wall 12. The lower end of the wall 30 is again suitably cut to form the series of ventilating openings 35 along the bottom of the compartment 14. The material cut to form the openings 35 is used as spacer members 36 which separate the wall 30 from the outer housing wall 12. The spacers also act to baffle the air flow which prevents a direct air draft from blowing through the openings 35 into the food compartment 14. The lower fold of the wall 30 also forms a ledge 38 to receive a planer insert 40 which serves as the bottom support surface for the food compartment 14.

Figure 4:
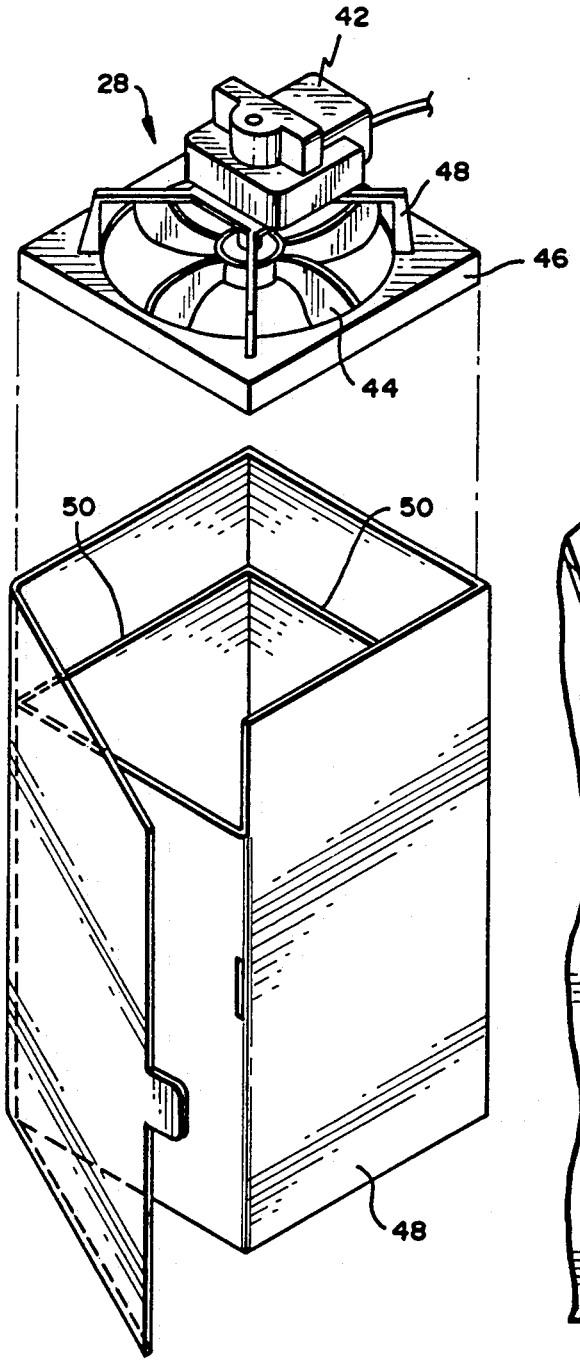
FIG. 4 is an exploded view of a detail of the unit.
Figure 5:
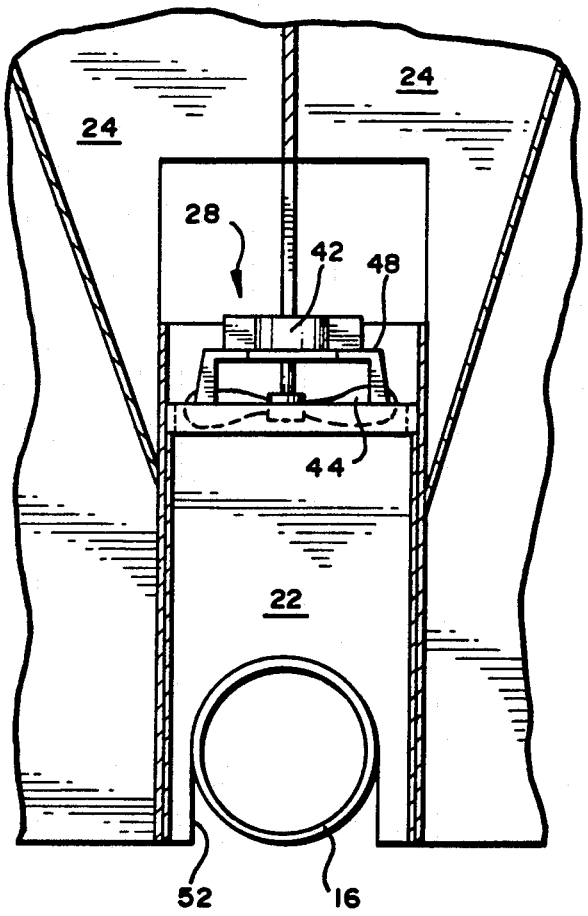
FIG. 5 is a sectional view of a detail of the unit.

Referring to FIGS. 4 and 5, the fan 28 includes a suitable AC motor 42 connected to an impeller 44 mounted on a support 46 by a suitable bracket 48. The air inlet chamber 22 is formed of a rectangular folded piece of cardboard 48 which includes a ledge 50 structured to receive the support 46 to suitably position and mount the fan 28. An opening 52 is formed in the cardboard member 48 to accommodate the inlet hose 16. A second hose opening 54 is also provided in the outer, housing 12 of the unit 10.

Figure 3:
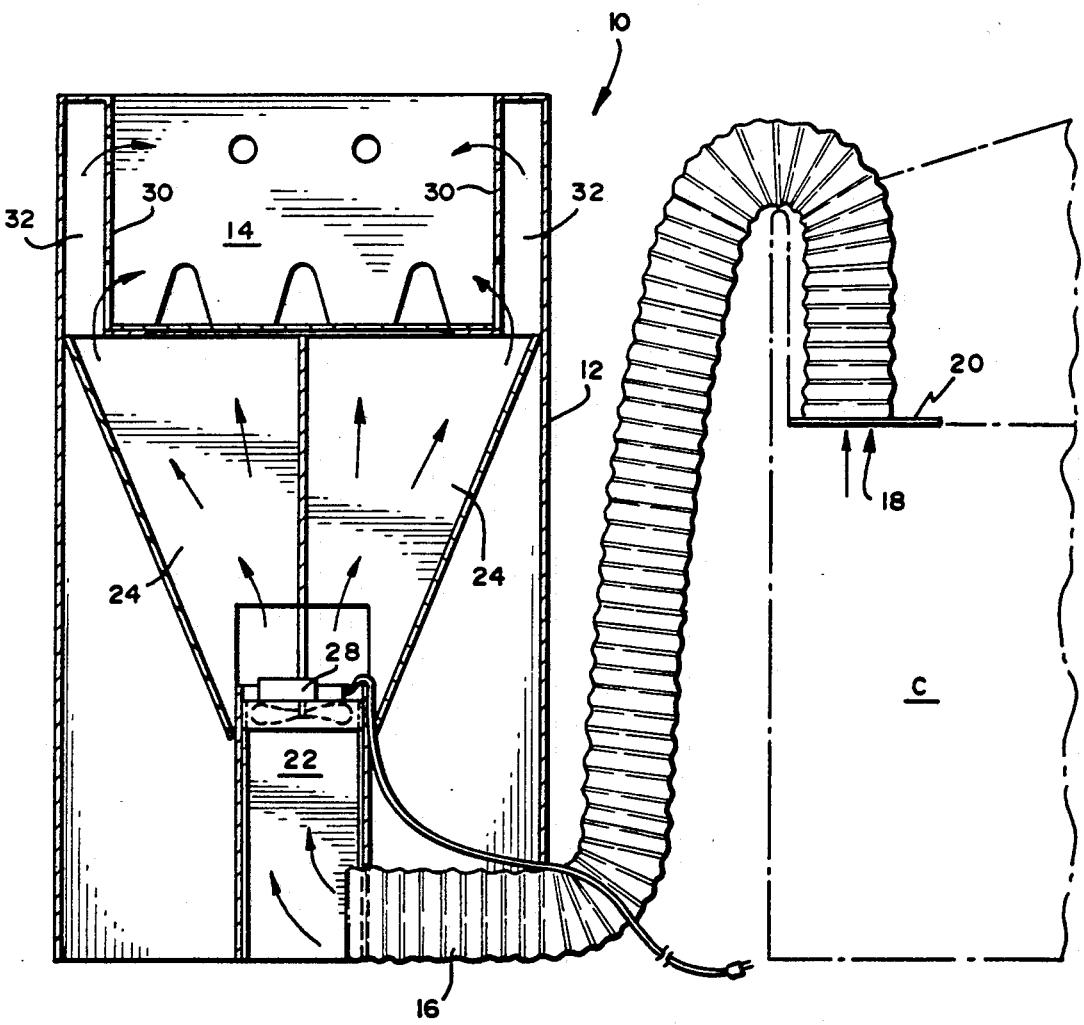
FIG. 3 is a side sectional view taken along the lines 3—3 of FIG. 1.

Referring to FIG. 3, the support 20 connected to the air inlet opening of the cold air inlet hose 16 is placed within a conventional refrigerated case (c) in a position to draw refrigerated air from the case into the auxilliary food storage cooling unit 10. The air is drawn by the fan into the inlet chamber 22, and then it is distributed into the funnel-shaped air distribution ducts 24. The majority of the air impinges against the planer support 40 in the bottom of the food compartment 14, and flows to the outer periphery of the unit and into the air distribution channel 32 located around the periphery of the food compartment 14. The air then enters the upper air openings 34 and lower air openings 35, and spills into the food compartment 14 thereby providing refrigerated air within the compartment. The spacer members 36 baffle the air, and prevent it from flowing directly through the openings 34, creating a turbulence which causes a more equal distribution of the air so that the entire food compartment becomes saturated with the cold air.

From the above description, it can be seen that the food storage and cooling unit can be made of relatively inexpensive and easy to handle materials including corrugated cardboard and other similar laminate materials. The unit is lightweight, and can be easily moved within a retail food outlet adjacent a refrigerated case to provide a point of sale promotional display and storage facility.

It will be appreciated that modifications may be made to the invention in keeping within the scope of the following claims.

I claim:

1. An auxiliary, portable storage and cooling unit for use in combination with a primary source of refrigerated air comprising:

a housing having inner and outer wall surfaces and including a support base and upper opening;

a product storage compartment formed in said upper opening of said housing;

a refrigerated air flow path including, an air inlet duct having an inlet opening structured to be in fluid communication with said primary source of refrigerated air; an air inlet chamber connected to said air inlet duct;

a plurality of funnel-shaped air distribution ducts increasing in size upwardly and outwardly from said air inlet chamber toward said housing inner wall surfaces;

a plurality of air distribution chambers located between said product storage compartment and said inner wall surfaces of said housing; and air flow openings formed in said product storage compartment permitting flow of refrigerated air from said air distribution chambers into said product storage compartment.

2. The unit of claim 1 further including an air distribution means located in said refrigerated air flow path.

3. The unit of claim 2 wherein said air distribution means is a motor driven fan.

4. The unit of claim 3 wherein said fan is located between said air inlet chamber and said air distribution ducts.

5. The unit of claim 1 wherein said air distribution ducts are centrally located in said housing and include common divider walls.

6. The unit of claim 1 further including baffle means located adjacent said air flow openings to interrupt air flow from said air distribution chamber to said product storage compartment.

7. The unit of claim 6 wherein said air flow openings are located in the said inner wall surfaces and adjacent the bottom of said product storage compartment permitting distribution of refrigerated air throughout said compartment.

8. The unit of claim 1 wherein said air distribution chambers are formed of an outer wall common with said housing and an inner wall formed of a spaced, folded over extension of said housing.

9. The unit of claim 8 further including spacers for positioning said folded over extension from said housing.

10. The unit of claim 1 wherein said product storage compartment includes a planer support base positioned on top of said air distribution ducts, blocking refrigerated air flow from said ducts under said storage compartment and forcing air flow toward the said housing inner wall surfaces at the periphery of the unit.

* * * * *